US006120415A

United States Patent [19]

Paull et al.

[11] Patent Number: 6,120,415

[45] Date of Patent: Sep. 19, 2000

[54] EXERCISE SUPPORT POLE

[76] Inventors: Jonathan M. Paull; Crystal J. Crouse, both of 107 St. John Street, Cannington, Ontario, Canada, L0E 1E0

[21] Appl. No.: 09/220,944

[22] Filed: Dec. 24, 1998

[51] Int. Cl.[7] ..... A63B 1/00

[52] U.S. Cl. ..... 482/38; 482/148

[58] Field of Search ..... 482/148, 38; 248/200, 248/205.1, 226.11; 362/432

[56] References Cited

U.S. PATENT DOCUMENTS

| | | | |
|---|---|---|---|
| 1,670,390 | 5/1928 | Strom | 482/38 |
| 3,849,933 | 11/1974 | Kuntz | 46/52 |
| 5,162,030 | 11/1992 | Tanski | 482/91 |
| 5,536,229 | 7/1996 | Albergo | 482/148 |
| 5,569,123 | 10/1996 | Creatchman | 482/39 |
| 5,678,698 | 10/1997 | Cabral | 211/33 |

*Primary Examiner*—Richard J. Apley
*Assistant Examiner*—Lori Baker

[57] ABSTRACT

A exercise support pole for assisting a user in stretching out muscles. The exercise support pole includes a generally vertical main pole that has upper and lower ends, front and rear sides, and first and second sides that are positioned between the front and rear sides. A plurality of foot rest members extend generally horizontally from the first side of the main pole and are positioned towards the lower end. A generally horizontal center bar is coupled to the main pole and positioned above the foot rest members.

19 Claims, 3 Drawing Sheets

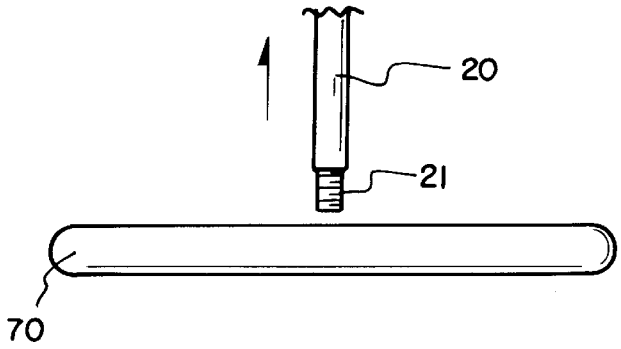
FIG. 6
FIG. 7
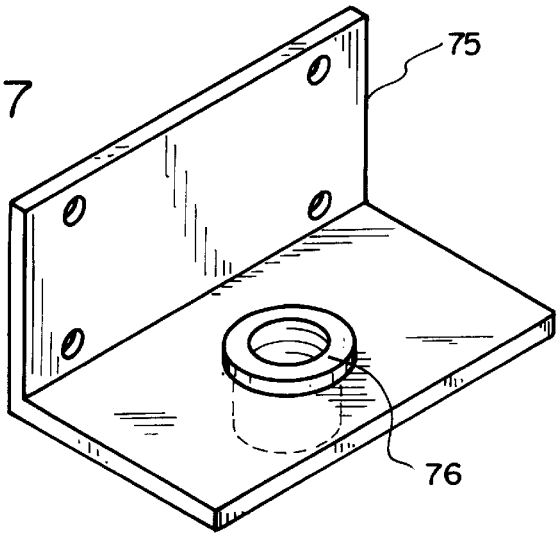
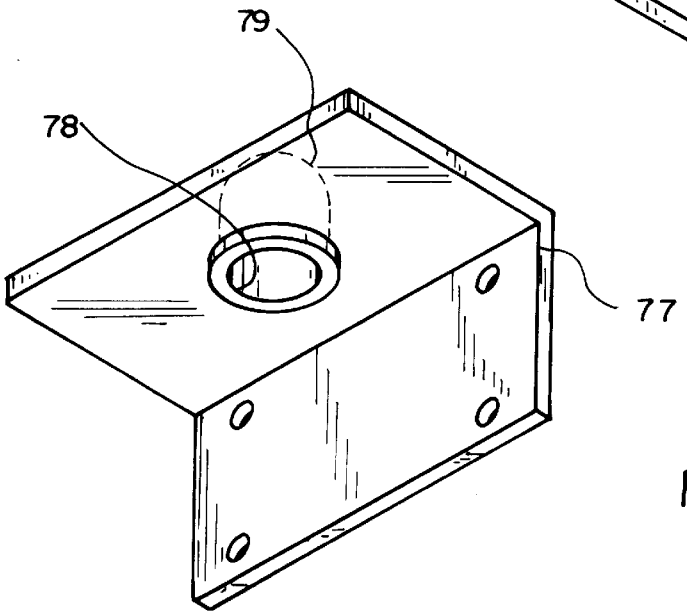
FIG. 8

EXERCISE SUPPORT POLE

BACKGROUND OF THE INVENTION

1. Field of the Invention

The present invention relates to exercise equipment and more particularly pertains to a new exercise support pole for assisting a user in stretching out muscles.

2. Description of the Prior Art

The use of exercise equipment is known in the prior art. More specifically, exercise equipment heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,932,090; U.S. Pat. No. 5,586,352; U.S. Pat. No. 3,479,990; U.S. Pat. No. 3,479,991; U.S. Pat. No. 3,595,209; and U.S. Pat. No. Des. 222,276.

While these devices fulfill their respective, particular objectives and requirements, the aforementioned patents do not disclose a new exercise support pole. The inventive device includes a generally vertical main pole that has upper and lower ends, front and rear sides, and first and second sides that are positioned between the front and rear sides. A plurality of foot rest members extend generally horizontally from the first side of the main pole and are positioned towards the lower end. A generally horizontal center bar is coupled to the main pole and positioned above the foot rest members.

In these respects, the exercise support pole according to the present invention substantially departs from the conventional concepts and designs of the prior art, and in so doing provides an apparatus primarily developed for the purpose of assisting a user in stretching out muscles.

SUMMARY OF THE INVENTION

In view of the foregoing disadvantages inherent in the known types of exercise equipment now present in the prior art, the present invention provides a new exercise support pole construction wherein the same can be utilized for assisting a user in stretching out muscles.

The general purpose of the present invention, which will be described subsequently in greater detail, is to provide a new exercise support pole apparatus and method which has many of the advantages of the exercise equipment mentioned heretofore and many novel features that result in a new exercise support pole which is not anticipated, rendered obvious, suggested, or even implied by any of the prior art exercise equipment, either alone or in any combination thereof.

To attain this, the present invention generally comprises a generally vertical main pole that has upper and lower ends, front and rear sides, and first and second sides that are positioned between the front and rear sides. A plurality of foot rest members extend generally horizontally from the first side of the main pole and are positioned towards the lower end. A generally horizontal center bar is coupled to the main pole and positioned above the foot rest members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exercise support pole apparatus and method which has many of the advantages of the exercise equipment mentioned heretofore and many novel features that result in a new exercise support pole which is not anticipated, rendered obvious, suggested, or even implied by any of the prior art exercise equipment, either alone or in any combination thereof.

It is another object of the present invention to provide a new exercise support pole which may be easily and efficiently manufactured and marketed.

It is a further object of the present invention to provide a new exercise support pole which is of a durable and reliable construction.

An even further object of the present invention is to provide a new exercise support pole which is susceptible of a low cost of manufacture with regard to both materials and labor, and which accordingly is then susceptible of low prices of sale to the consuming public, thereby making such exercise support pole economically available to the buying public.

Still yet another object of the present invention is to provide a new exercise support pole which provides in the apparatuses and methods of the prior art some of the advantages thereof, while simultaneously overcoming some of the disadvantages normally associated therewith.

Still another object of the present invention is to provide a new exercise support pole for assisting a user in stretching out muscles.

Yet another object of the present invention is to provide a new exercise support pole which includes a generally vertical main pole that has upper and lower ends, front and rear sides, and first and second sides that are positioned between the front and rear sides. A plurality of foot rest members extend generally horizontally from the first side of the main pole and are positioned towards the lower end. A generally horizontal center bar is coupled to the main pole and positioned above the foot rest members.

Still yet another object of the present invention is to provide a new exercise support pole that takes up little space.

Even still another object of the present invention is to provide a new exercise support pole that has varying levels of support members so that a user can stretch the same muscle group in many different directions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a schematic partial side view of the present invention.

FIG. 7 is a schematic perspective view of an upper mounting bracket of the present invention.

FIG. 8 is a schematic perspective view of a lower mounting bracket of the present invention.

DESCRIPTION OF THE PREFERRED EMBODIMENT

Figure 1:
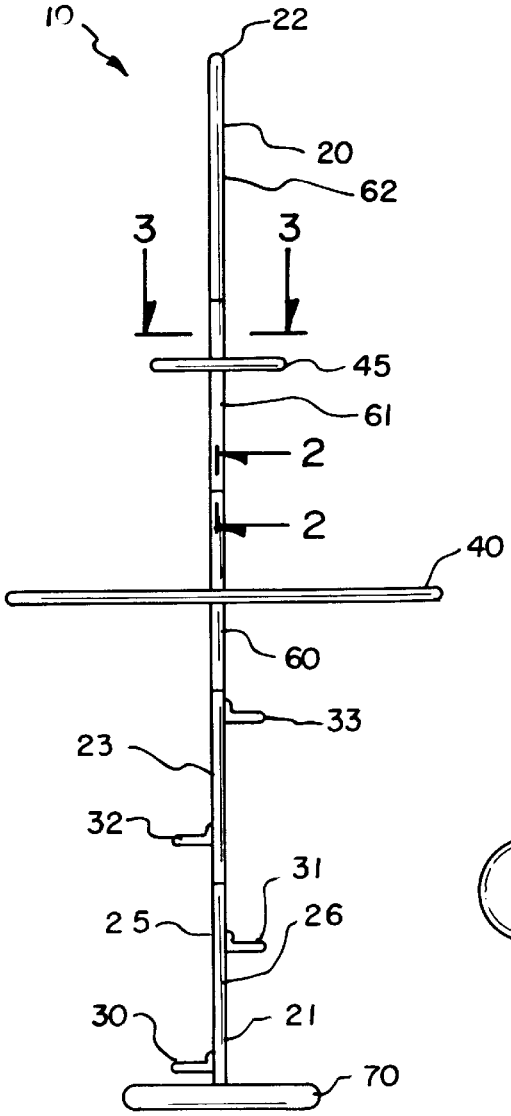
FIG. 1 is a schematic front view of a new exercise support pole according to the present invention.

With reference now to the drawings, and in particular to FIGS. 1 through 8 thereof, a new exercise support pole embodying the principles and concepts of the present invention and generally designated by the reference numeral 10 will be described.

As best illustrated in FIGS. 1 through 8, the exercise support pole 10 generally comprises a generally vertical main pole 20 that has upper and lower ends 22,21, front and rear sides 23,24, and first and second sides 25,26 that arc positioned between the front and rear sides 23,24. A plurality of foot rest members 30–33 extend generally horizontally from the first side 25 of the main pole 20 and are positioned towards the lower end 21. A generally horizontal center bar 40 is coupled to the main pole 20 and positioned above the foot rest members.

In more detail, the generally vertical main pole 20 has a threaded lower end 21 and a rounded upper end 22. The front side 23 faces a user. Preferably, the distance between the upper and lower ends 22,21 of the main pole 20 is between about fifty and one hundred twenty inches, ideally ninety six inches. The main pole 20 has a generally round transverse cross-section and has a diameter of between about one inch and five inches, ideally two inches.

A first foot rest member 30 extends generally horizontally from the first side 25 of the main pole 20 and is positioned towards the lower end 21. Ideally, the first foot rest member 30 is positioned between about one-half and three inches, ideally about one inch, above the lower end 21 of the main pole 20.

Preferably, a second foot rest member 31 extends generally horizontally from the second side 26 of the main pole 20 and is positioned above the first foot rest member 30. Ideally, the second foot rest member 31 is positioned between about five and sixteen inches, ideally about twelve inches, above the lower end 21 of the main pole 20.

More preferably, a third foot rest member 32 extends generally horizontally from the first side 25 of the main pole 20 and is positioned above the second foot rest member 31. Ideally, the third foot rest member 32 is positioned between about seventeen and twenty nine inches, ideally about twenty four inches, above the lower end 21 of the main pole 20.

Most preferably, a fourth foot rest member 33 extends generally horizontally from the second side 26 of the main pole 20 and is positioned above the third foot rest member 32. Ideally, the fourth foot rest member 33 being positioned between about thirty and forty inches, ideally about thirty six inches, above the lower end 21 of the main pole 20.

A generally horizontal center bar 40 is coupled to the front side 23 of the main pole 20. Preferably, the center bar 40 has a flange 41 that extends from a center portion thereof. The flange 41 has an aperture therein for receiving the main pole 20. The preferred length of the center bar 40 between opposite ends thereof is between about twenty four and forty inches and ideally about thirty two inches. The preferred placement of the center bar 40 is between about forty and fifty inches, ideally about forty six inches, above the lower end 21 of the main pole 20. Also preferably, the center bar 40 has a generally round transverse cross-section and has a diameter of between about one half and four inches, ideally about one inch.

Figure 3:
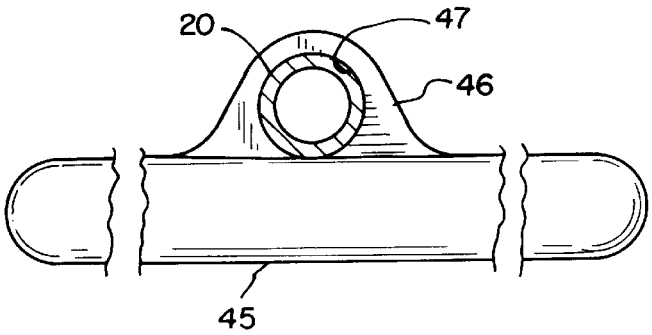
FIG. 3 is a schematic cross-sectional view of the present invention taken from line 3—3 of FIG. 1.
Figure 5:
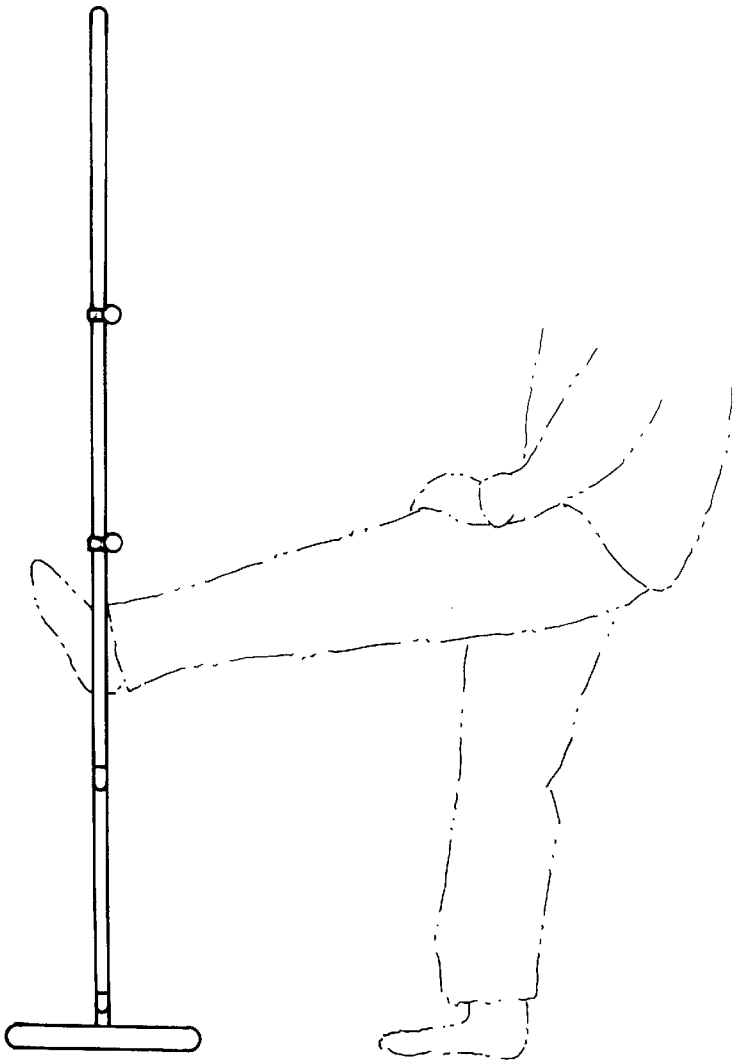
FIG. 5 is a schematic side view of the present invention.
Figure 4:
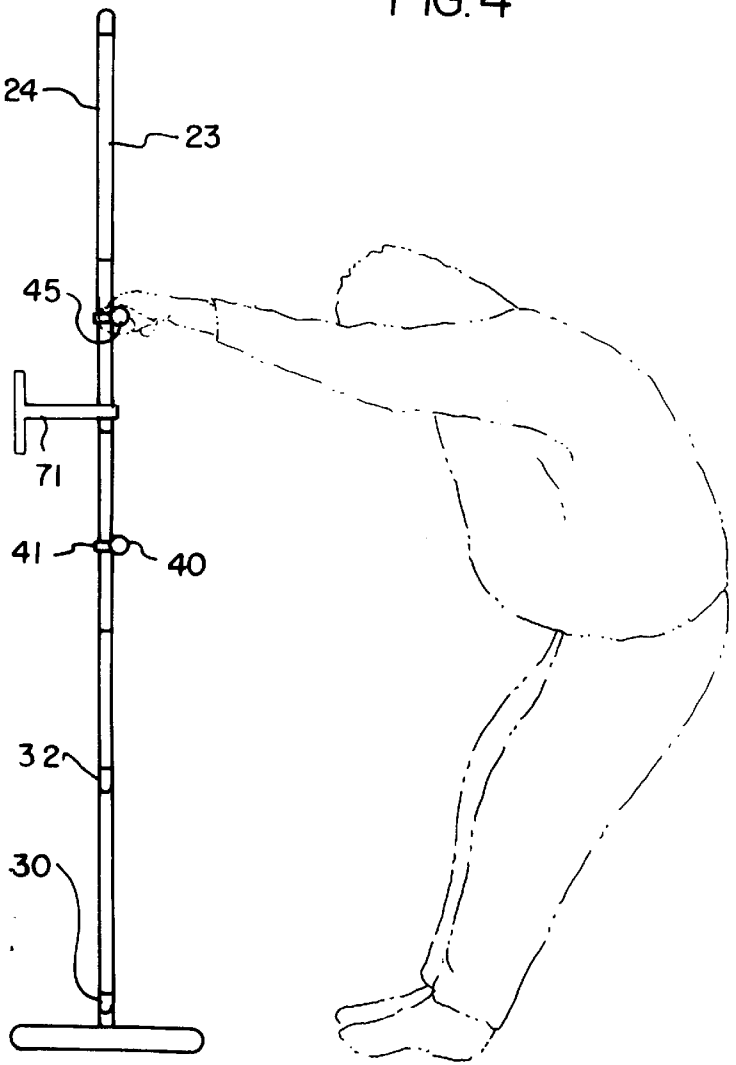
FIG. 4 is a schematic side view of the present invention.

Preferably, a generally horizontal upper bar 45 is coupled to the front side 23 of the main pole 20. As shown in FIG. 3, the upper bar 45 has a flange 46 that extends from a center portion thereof. The flange 46 has an aperture 47 therein for receiving the main pole 20. The preferred length of the upper bar 45 between opposite ends thereof is between about ten and twenty four inches, ideally about sixteen inches. The preferred placement of the center bar 40 is between about fifty and sixty inches, ideally about fifty five inches, above the lower end 21 of the main pole 20. Also preferably, the upper bar 45 has a generally round transverse cross-section and has a diameter of between about one half and four inches, ideally about one inch.

Figure 2:
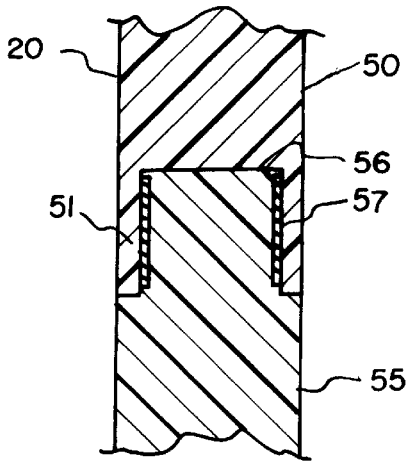
FIG. 2 is a schematic cross-sectional view of the present invention taken from line 2—2 of FIG. 1.

Preferably, as shown in FIG. 2, the main pole 20 comprises separable top and bottom section 50,55. The top section 50 has a sleeve 51 that extends from a bottom end thereof. The bottom section 55 has an insertion portion 56 that is slidably insertable in the sleeve 51 of the top section 50 to removably couple the top and bottom sections 50,55 of the main pole 20. Ideally, the insertion portion 56 of the bottom section 55 of the main pole 20 has a rubber collar 57 extending therearound to help provide friction between the top and bottom sections 50,55 of the main pole 20. Also ideally, the point of coupling of the top and bottom sections 50,55 is positioned about fifty four and one half inches above the lower end 21 of the main pole 20.

Ideally, the main pole 20 has a plurality of colored sections for permitting visual association of a portion of the main pole 20 with a type of muscle to be stretched, such as three colored portions being associated with stretching the upper, middle, and lower pectoral muscles respectively. In such an embodiment, a first colored portion 60 extends along a length of the main pole 20 between about thirty six inches and about fifty four and one half inches from the lower end 21 of the main pole 20. A second colored portion 61 extends along a length of the main pole 20 between about fifty four and one half inches and about seventy five inches from the lower end 21 of the main pole 20. A third colored portion 62 extends along a length of the main pole 20 between about seventy five inches from the lower end 21 of the main pole 20 and the upper end 22 of the main pole 20.

To support the device 10 in a free-standing orientation, as shown in FIGS. 1 through 5, a generally circular lower base portion 70 has a threaded hole therein for receiving the threaded lower end 21 of the main pole 20. A central mounting portion 71 extends from a surface such as a wall and is coupled to a central portion of the main pole 20.

The device may also be mounted to a wall. A lower mounting bracket 75, as shown in FIG. 7, has a threaded hole therein for receiving the threaded lower end 21 of the main pole 20. Ideally, the lower mounting bracket 75 has a threaded socket 76 that extends from an outer periphery of the threaded hole to receive the lower end 21 of the main pole 20. As shown in FIG. 8, an upper mounting bracket 77 has a receiving aperture 78 for receiving the upper end 22 of the main pole 20. Ideally, the upper mounting bracket 77 has a bulbous socket 79 that extends from an outer periphery of the receiving aperture 78 for receiving the upper end 22 of the main pole 20.

It is important to stretch out properly before exercising or playing a sport since warm, loose muscles perform better and have less chance of being injured. To stretch the shoulders and upper pectoral muscles, a user would hold the top section 50 of the main pole 20 with his thumb pointing upward, face away from the pole, and step forward so that his arm extends out behind his shoulder until a sensation of stretching is felt. After holding the stretch for several seconds, the user could relax and then repeat the movement one or two more times before switching to the other arm. The user could also perform this stretch by reaching farther up the main pole 20 and crouching down slightly without allowing his or her grip to slip. To stretch the back and shoulders, the user would face the pole, hold the center bar 40 in each hand, and bend over from the waist. To stretch his lats, a user could also lean back as he or she bends.

After the user has stretched upper body, he or she would stretch the hamstrings by placing one foot on one of the foot rest members 30–33, keeping the knee straight, and bending over from the waist. As the user's flexibility increased, the user would move to a higher footrest. Finally, the user would stretch the calves by standing with the feet close together and facing the pole ad then leaning forward to grip the upper bar 45 while keeping the knees straight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exercise device for assisting a user in stretching out muscles, comprising:

a generally vertical main pole having upper and lower ends, front and rear sides, and first and second sides being positioned between said front and rear sides, said front side facing a user;

a first foot rest member extending generally horizontally from said first side of said main pole and positioned towards said lower end;

a generally horizontal center bar being coupled to said main pole and positioned above said first foot rest member; and said main pole comprising separable top and bottom sections, said top section having a sleeve being extended from a bottom end thereof, said bottom section having an insertion portion being slidably insertable in said sleeve of said top section for removably coupling said top and bottom sections of said main pole, wherein said insertion portion of said bottom section of said main pole has an elastomeric collar extending therearound for helping provide friction between said top and bottom sections of said main pole.

2. The exercise device of claim 1, further comprising a second foot rest member extending generally horizontally from said second side of said main pole and positioned above said first foot rest member.

3. The exercise device of claim 2, further comprising a third foot rest member extending generally horizontally from said first side of said main pole and positioned above said second foot rest member.

4. The exercise device of claim 3, further comprising a fourth foot rest member extending generally horizontally from said second side of said main pole and positioned above said third foot rest member.

5. The exercise device of claim 4, wherein said first foot rest member is positioned between about one-half and three inches above said lower end of said main pole, said second foot rest member being positioned between about five and sixteen inches above said lower end of said main pole, said third foot rest member being positioned between about seventeen and twenty nine inches above said lower end of said main pole, said fourth foot rest member being positioned between about thirty and forty inches above said lower end of said main pole.

6. The exercise device of claim 1, wherein the length of said center bar between opposite ends thereof is between about twenty four and forty inches.

7. The exercise device of claim 1, wherein said center bar is positioned between about forty and fifty inches above said lower end of said main pole.

8. The exercise device of claim 1, further comprising a generally horizontal upper bar being coupled to said front side of said main pole and positioned above said center bar.

9. The exercise device of claim 8, wherein the length of said upper bar between opposite ends thereof is between about ten and twenty four inches.

10. The exercise device of claim 8, wherein said center bar is positioned between about fifty and sixty inches above said lower end of said main pole.

11. The exercise device of claim 10, wherein said center bar has a flange being extended from a center portion thereof, said flange of said center bar having an aperture therein for receiving said main pole, said upper bar having a flange being extended from a center portion thereof, said flange of said upper bar having an aperture therein for receiving said main pole.

12. An exercise device for assisting a user in stretching out muscles, comprising:

a generally vertical main pole having upper and lower ends, front and rear sides, and first and second sides being positioned between said front and rear sides, said front side facing a user;

a first foot rest member extending generally horizontally from said first side of said main pole and positioned towards said lower end;

a generally horizontal center bar being coupled to said main pole and positioned above said first foot rest member; and said main pole comprising separable top and bottom sections, said top section having a sleeve being extended from a bottom end thereof, said bottom section having an insertion portion being slidably insertable in said sleeve of said top section for removably coupling said top and bottom sections of said main pole, wherein said insertion portion of said bottom section of said main pole has a rubber collar extending therearound for helping provide friction between said top and bottom sections of said main pole.

13. The exercise device of claim 1, wherein said main pole has a plurality of colored sections for permitting visual association of a portion of said main pole with a type of muscle to be stretched.

14. The exercise device of claim 13, wherein said a first colored portion extends along a length of said main pole between about thirty six inches and about fifty four and one half inches from said lower end of said main pole, a second colored portion extending along a length of said main pole between about fifty four and one half inches and about seventy five inches from said lower end of said main pole, a third colored portion extending along a length of said main pole between about seventy five inches from said lower end of said main pole and said upper end of said main pole.

15. The exercise device of claim 1, further comprising a lower base portion being generally circular and having a threaded hole therein for receiving said threaded lower end of said main pole.

16. The exercise device of claim 15, further comprising a central mounting portion being extended from a surface and being coupled to a central portion of said main pole.

17. The exercise device of claim 1, further comprising a lower mounting bracket having a threaded hole therein for receiving said threaded lower end of said main pole, and an upper mounting bracket having a receiving aperture for receiving said upper end of said main pole.

18. The exercise device of claim 17, wherein said lower mounting bracket has a threaded socket being extended from an outer periphery of said threaded hole for receiving said lower end of said main pole, said upper mounting bracket having a bulbous socket being extended from an outer periphery of said receiving aperture for receiving said upper end of said main pole.

19. An exercise device for assisting a user in stretching out muscles, comprising:

a generally vertical main pole having a threaded lower end, a rounded upper end, front and rear sides, and first and second sides being positioned between said front and rear sides, said front side facing a user;

wherein the distance between said upper and lower ends of said main pole is between about fifty and one hundred twenty inches;

wherein said main pole has a generally round transverse cross-section and wherein the diameter of the main pole is between about one inch and five inches;

a first foot rest member extending generally horizontally from said first side of said main pole and positioned towards said lower end, said first foot rest member being positioned between about one-half and three inches above said lower end of said main pole;

a second foot rest member extending generally horizontally from said second side of said main pole and positioned above said first foot rest member, said second foot rest member being positioned between about five and sixteen inches above said lower end of said main pole;

a third foot rest member extending generally horizontally from said first side of said main pole and positioned above said second foot rest member, said third foot rest member being positioned between about seventeen and twenty nine inches above said lower end of said main pole;

a fourth foot rest member extending generally horizontally from said second side of said main pole and positioned above said third foot rest member, said fourth foot rest member being positioned between about thirty and forty inches above said lower end of said main pole;

a generally horizontal center bar being coupled to said front side of said main pole, said center bar having a flange being extended from a center portion thereof, said flange having an aperture therein for receiving said main pole;

wherein the length of said center bar between opposite ends thereof is between about twenty four and forty inches, wherein said center bar is positioned between about forty and fifty inches above said lower end of said main pole;

wherein the center bar has a generally round transverse cross-section and wherein the diameter of the center bar is between about one half and four inches;

a generally horizontal upper bar being coupled to said front side of said main pole, said upper bar having a flange being extended from a center portion thereof, said flange having an aperture therein for receiving said main pole;

wherein the length of said upper bar between opposite ends thereof is between about ten and twenty four inches, wherein said center bar is positioned between about fifty and sixty inches above said lower end of said main pole;

wherein the upper bar has a generally round transverse cross-section and wherein the diameter of the upper bar is between about one half and four inches;

wherein said main pole comprises separable top and bottom sections, said top section having a sleeve being extended from a bottom end thereof, said bottom section having an insertion portion being slidably insertable in said sleeve of said top section for removably coupling said top and bottom sections of said main pole;

said insertion portion of said bottom section of said main pole having a rubber collar extending therearound for helping provide friction between said top and bottom sections of said main pole;

wherein said main pole has a plurality of colored sections for permitting visual association of a portion of said main pole with a type of muscle to be stretched, a first colored portion extending along a length of said main pole between about thirty six inches and about fifty four and one half inches from said lower end of said main pole, a second colored portion extending along a length of said main pole between about fifty four and one half inches and about seventy five inches from said lower end of said main pole, a third colored portion extending along a length of said main pole between about seventy five inches from said lower end of said main pole and said upper end of said main pole;

a lower base portion being generally circular and having a threaded hole therein for receiving said threaded lower end of said main pole; and a central mounting portion being extended from a surface and being coupled to a central portion of said main pole.

* * * * *